United States Patent [19]

Riparbelli

[11] 3,935,817

[45] Feb. 3, 1976

[54] PENETRATING SPEAR

[75] Inventor: Carlo Riparbelli, Pomona, Calif.

[73] Assignee: General Dynamics Corporation, Pomona, Calif.

[22] Filed: Jan. 22, 1973

[21] Appl. No.: 325,716

Related U.S. Application Data

[63] Continuation-in-part of Ser. No. 172,335, July 28, 1971, abandoned.

[52] U.S. Cl. ..... 102/52; 102/49.3

[51] Int. Cl.[2] ..... F42B 11/14

[58] Field of Search ..... 102/49.4, 49.2, 49.7, 49.8, 102/49.3, DIG. 7, 48, 52, 7.2

[56] References Cited

UNITED STATES PATENTS

| | | | |
|---|---|---|---|
| 333,552 | 1/1886 | Schneider | 102/48 |
| 2,145,507 | 1/1939 | Denoix | 102/49.4 X |
| 2,741,180 | 4/1956 | Meister | 102/52 |
| 2,804,823 | 9/1957 | Jablansky | 102/49.4 |
| 3,318,241 | 5/1967 | Gould | 102/7.2 |
| 3,521,564 | 7/1970 | Gould et al. | 102/49.7 |

*Primary Examiner*—Stephen C. Bentley
*Assistant Examiner*—Harold Tudor
*Attorney, Agent, or Firm*—Albert J. Miller; Edward B. Johnson

[57] ABSTRACT

Disclosed is a spear having an elongated rod to penetrate hard targets. The spear is delivered either from the air or the ground and is accelerated by a rocket motor to achieve the required impact velocity, for penetration.

4 Claims, 12 Drawing Figures

PENETRATING SPEAR

CROSS REFERENCE TO RELATED APPLICATION

This application is a Continuation-in-Part of application Serial No. 172,335 in the name of Carlo Riparbelli, filed 28 July 1971, now abandoned and entitled Penetrating Spear and Delivery Method Therefor.

BACKGROUND OF THE INVENTION

Conventional bombs and rockets are largely ineffective against hardened targets, particularly underground concrete structures or bunkers protected by layers of soil, sand or rock. These weapons deliver their destructive energy in various forms and in all directions and therefor cannot penetrate the layers of soil, sand or rock to reach the hardened target. The present invention is adapted to be effective against and destroy such targets.

SUMMARY OF THE INVENTION

The invention relates to a penetrating spear for use against hardened targets. The spear, which has a solid elongated rod, utilizes one-directional kinetic energy to penetrate through layers of soil, sand, or rock to still penetrate a concrete bunker. The rod may include an enlarged, bulb-shaped front end and various aerodynamic surfaces for stability, control, and/or guidance. Rocket motors are provided at or near the rear of the rod to impart acceleration before impact of the spear. Both the aerodynamic surfaces and the rocket motors may be affixed to the rod by tapered collars which will slide off upon impact of the spear. An explosive charge, which may include a shock absorber, is included at the rear of the rod, while a shaped charge can be included before the bulb-shaped front end to facilitate penetration.

The spears can be launched from aircraft either like a free falling bomb, during a dive, or into a porpoise type maneuver. Multiple spears can be included in a container and released at a prescribed altitude. Surface launching of the spears is also possible.

DESCRIPTION OF THE PREFERRED EMBODIMENTS

Figure 1:
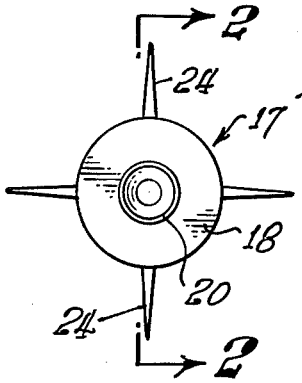
FIG. 1 is a rear end view of a spear of the present invention.
Figure 2:
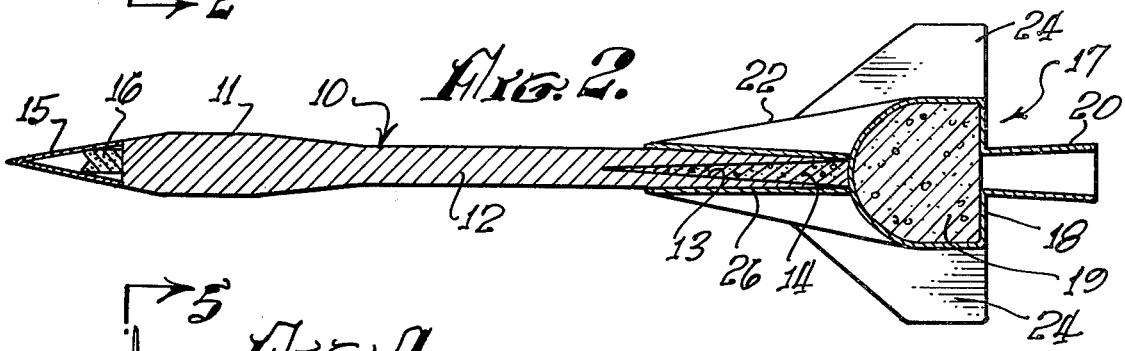
FIG. 2 is a sectional side view of the spear of FIG. 1 taken along line 2—2.

As illustrated in FIGS. 1 and 2, the spear basically comprises an elongated solid metal shaft or rod 10 having a length many times its diameter. The rod 10 has a blunt bulb-shaped front end 11 which has a diameter slightly larger than the remainder of the rod 10 which is considered as the stem 12. A conical cavity 13 at the rear of the stem 12 contains an explosive charge 14 which may include a pyrotechnic fuse. If desired, the stem 12 may be tapered, with the rear portion thereof having the smallest diameter.

A frontal conical aerodynamic fairing 15 which may contain a hollow shaped charge 16 or a guidance device is provided at the blunt front end 11 of the rod 10. A collar 26 to which aerodynamic fairing surfaces 22 are affixed is provided around the rear of the stem 12. The collar 26 is designed to slide off the stem following impact of the spear with a target. The collar 26 need not necessarily be a one-piece cylindrical member. The collar 26 may be completely or only partially changed into segments or shoes slidably disposed around the stem 12 and which may or may not be joined one to the other and which may or may not be arcuate in form. Mounted at the rear of the stem 12 and affixed to the collar 26 is a rocket motor 17. The rocket motor 17 includes a casing 18 to contain a propellant charge 19 which is ignited, for example, by a squib and a firing circuit (not shown). Hot gases generated by the ignited propellant charge 19 are expended through a nozzle 20 which is fixed in the rearward or aft end portion of the casing 18. Extending rearward from the stem 12 to the rocket motor 17 are a plurality of aerodynamic fairing surfaces 22. A plurality of aerodynamic stabilizer tail surfaces 24 project outward from the rocket motor 17.

Figure 9:
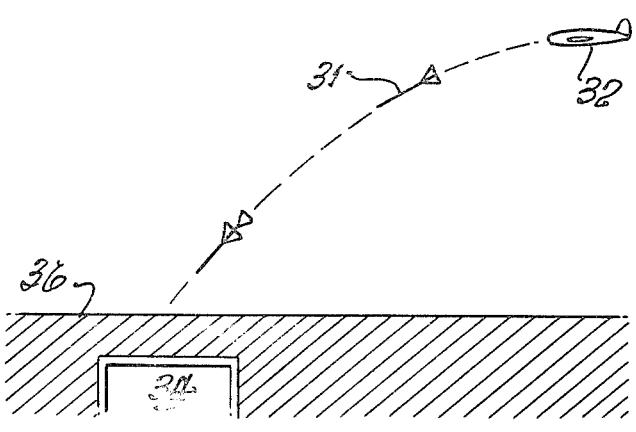
FIG. 9 is a schematic view of a spear dropped from an aircraft.

While the spear depicted in FIGS. 1 and 2 can be launched in any number of different fashions, it is particularly adapted to be dropped from an aircraft or helicopter as shown in FIG. 9. The spear 31 is dropped from the aircraft 32 into a free fall path much like an ordinary bomb. When the spear 31 reaches a predetermined distance above the target 34, the rocket motor 17 is ignited to accelerate the spear to a high velocity before impact above the target 34 which lies below the surface of the ground 36. The spear axially impacts the ground 36 and travels through it until it perforates the target 34. The explosive charge 14 is then exploded after penetration is completed.

Figure 3:
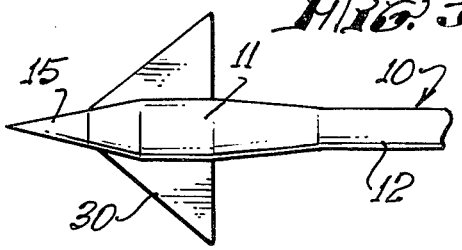
FIG. 3 is a partial side view of a winged spear of the present invention.

A plurality of triangular wings surfaces 30 may be added to the spear as shown in FIG. 3. The wings 30 extended over the enlarged or bulb-shaped front end 11 of the rod 10.

Figure 4:
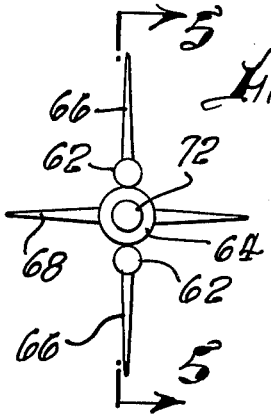
FIG. 4 is a rear end view of a winged spear having collar type attachments.
Figure 5:
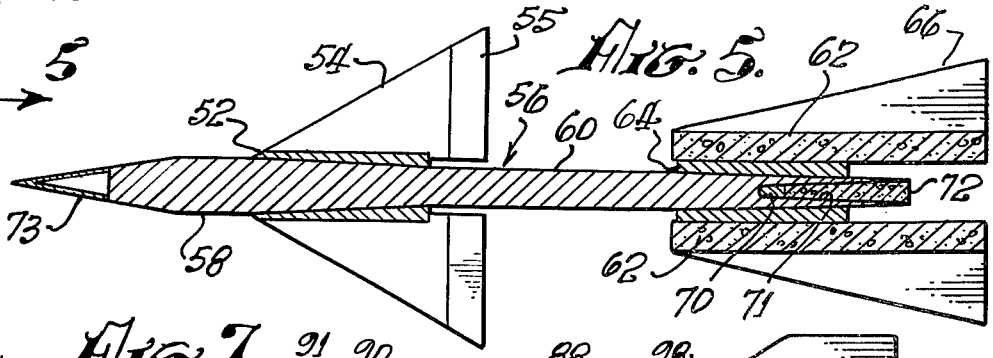
FIG. 5 is a sectional side view of the winged spear of FIG. 4 taken along line 5—5.

One method of attaching these wings and the other aerodynamic surfaces to the spear is illustrated in FIGS. 4 and 5. A collar 52 to which the wings 54 are affixd is provided around the tapered section of the rod 56 extending rearward from the bulb-shaped front end 58. The wings 54 may include ailerons 55 to provide simple roll control for the spear during free flight. The rocket motors 62 are likewise mounted on a collar 64 which is provided around the rear portion of the stem 60. Opposed triangular tail surfaces 66 extend outward from the rocket motors 62 while opposed tail surfaces 68 extend outward from the rear portion of the stem 60. A frontal fairing 73 is also provided. A shock absorber 70 of a material such as tar or honeycomb may be provided at the forward end of the rear conical cavity 71 which contains explosive charge 72 to prevent premature detonation of the charge 72 upon impact.

Figure 6:
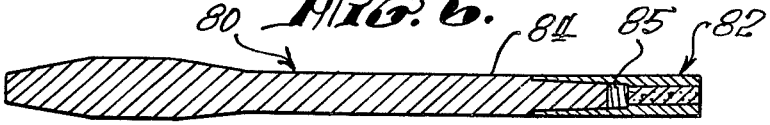
FIG. 6 is a sectional side view of spear rod having a separate warhead.

Alternately as shown in FIG. 6, a separate explosive charge or warhead 82 may be attached to the stem 84 through a shock absorber 85. The outer diameter of the charge 82 should be thee same as the diameter of the stem 84 of the rod 80.

Figure 10:
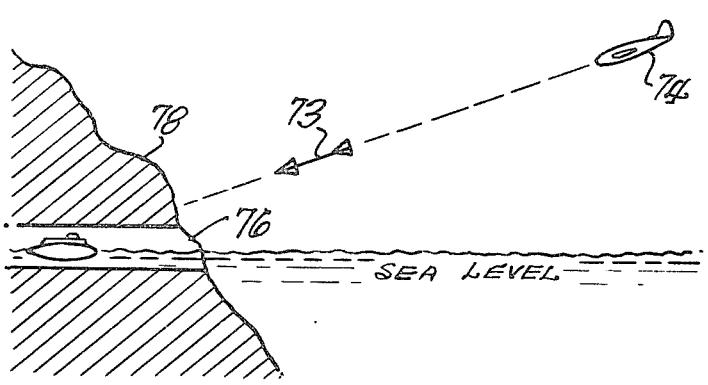
FIG. 10 is a schematic view of a spear launched from a diving aircraft.

The winged spear while capable of being launched or delivered in a number of ways is particularly effective when launched from a diving aircraft as shown in FIG. 10. The winged spear 73 flies like a rocket-propelled missile when launched from the diving aircraft 74 against a target such as a submarine pen 76 carved in rock 78. The flight path of the spear 73 will be substantially straight unless guidance is provided. Launching the spear 73 from a diving aircraft utilizes the velocity of the aircraft 74 at launch and permits the utilization of rocket motors having reasonably long burning times. Axial impact is more easily achieved since the oscillations typical of bombs in free fall are avoided.

Figure 7:
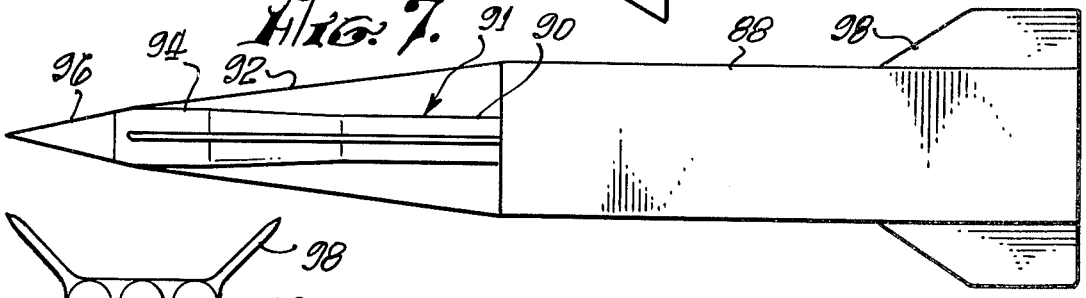
FIG. 7 is a side view of a clustered rocket motor spear.
Figure 8:
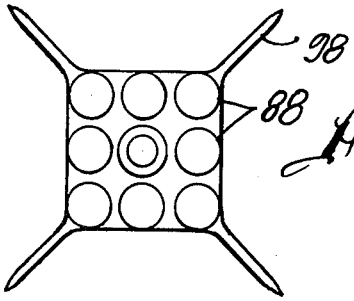
FIG. 8 is a rear-end view of the clustered rocket motor spear of FIG. 7.

FIGS. 7 and 8 illustrate a spear having a plurality or cluster of rocket motors 88 positioned around the stem 90 of the spear rod 91. Aerodynamic fairing surfaces 92 extend from the enlarged blunt front end 94 to the motors 88. The spear includes the frontal conical aerodynamic fairing 96 and a plurality of tail surfaces 98.

Figure 11:
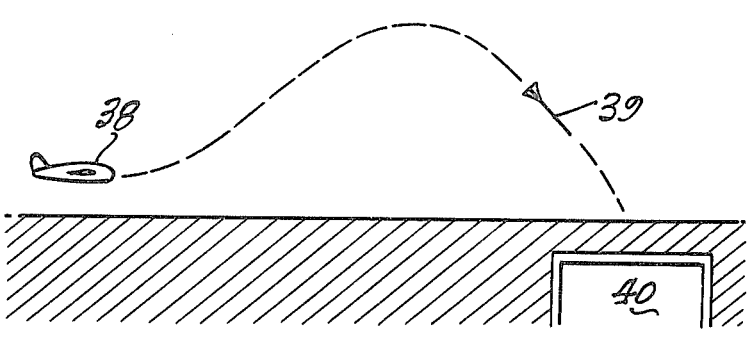
FIG. 11 is a schematic view of a spear launched from a low flying aircraft.
Figure 12:
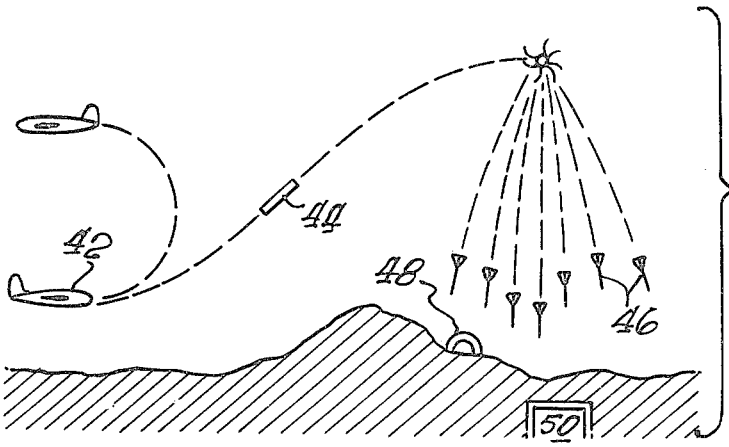
FIG. 12 is a schematic view of the launching of multiple spears from a low flying aircraft.

If it is desired to launch the spear from high velocity aircraft flying at very low altitude, it may be necessary to deliver the spear as shown in FIGS. 11 or 12. Here, the spear is launched from the aircraft to first fly upward and gain some altitude before its path curves downward towards the target. A small propulsion charge can be used in order to have the spear clear the aircraft. This porpoise type maneuver can be achieved in a number of different ways such as by including a time controlled spear surface to control the angle of attack or by rigidly fixing all of the control surfaces for a climb angle of attack and then forcibly detaching the surfaces with a small exposive charge at the prescribed altitude. Alternately the phugoid motion flight-dynamics stability can be utilized. In either event the rocket motor or motors would be fired near the end of the downward path to achieve the necessary impact velocity.

In FIG. 11, a single spear 39 is launched from an aircraft 38 against an underground target 40. In FIG. 12 a container 44 including a plurality of individual spears 46 is launched from an aircraft 42. The individual spears 46 are ejected from the container 44 at the prescribed altitude against targets 48 and 50. The low flying aircraft may continue on its path or, as shown in FIG. 12, the aircraft may climb into a loop away from the targets.

The spear is designed to destroy undergound bunkers even if they are protected by layers of soil or sand many feet thick or if they are caverns cut in rock. Properly configured, the spear can easily perforate 15 to 20 feet of concrete or 100 feet of sand. The type of target material and a pre-established penetration depth will determine the optimum spear length and the impact velocity required.

The spear differs from a bomb in that the spear's energy is primarily kinetic and in a single direction while the energy released by a bomb is in several forms and propagates in all directions. Thus the penetration which can be achieved in a given type of ground by the spear is much larger than the penetration from a bomb.

The maximum spear penetration is achieved by an optimum balance between spear length and impact velocity when considered with the spear material and the target materials.

While an explosive charge may be contained at the rear of the spear stem, extensive damage to the target can be achieved simply by spallation of the target bunker's ceiling and the fall of loosened soil through the perforated bunker ceiling. When a ship is the target, the spear can perforate any number of decks and finally the hull of the ship impacted from above. A spear designed for use against ships would usually be shorter than a spear for a hard underground target and there would not be any necessity for the bulb-shaped front end.

Since a deep penetration requires a large impact velocity, considerable erosion of the front of the spear is envisioned and can be tolerated without damage to the explosive charge. With increasing penetration, the velocity of the spear decreases and the rate of erosion decreases with it until it ends. After the erosion is ended, the spear continues on its path while undergoing further deceleration due to terradynamic drag until finally it comes to rest. Since optimum impact velocities cannot be achieved by free fall except from extremely high altitudes, rocket motors are usually required.

From the standpoint of the spear design, the final state of stress when the spear and the ground are at rest after penetration is of no interest. However, the sequence which leads to it is important.

The primary contact during penetration takes place between the front surface of the spear and the bottom of the crater. The target material is initially compressed ahead of the advancing spear's front. It subsequently expands, overshooting by inertia the radius of the spear. The target material opens into a wide crater and it does not touch the lateral surface of the spear over a considerable length. This effect finds its counterpart in the cavity around a torpedo penetrating water. Just like a cavity in water finally closes in the back, so the earth rebounds and closes the crater with considerable residual pressure. If the spear is at rest the earth closes it in a tight grip.

If the spear is so long that the ground rebounds gripping the tail end of it, this may hamper further penetration and may even stop the spear or break it by tension. For this reason the time period during which the crater opens and closes back must be long enough so that the rebounding ground does not grip the tail end of the spear. This condition depends on the length and velocity of the spear and on the profile of the crater which in turn depends on the diameter of the front end.

The length of the spear is determined by the penetration depth to be achieved and it is a function of the impact velocity, of the material of the spear, and of the target material. It is also limited by the maximum weight and length allowed by the carrier. For a given impact velocity the penetration depth is roughly proportional to the length of the spear.

Above a minimum diameter necessary to avoid buckling, the penetration depth does not depend on the diameter of the spear. The damage imposed on the target increases with at least the square of the diameter, i.e. with the volumes of the spallation plug and of the explosive charge. Of course, for a given length, the weight also increases with the square of the diameter and, for the optimum velocity, so do the necessary impulse and the weight of the rocket motors. If the spear penetrates the target with considerable residual velocity, fragments from the target ceiling will be launched with considerable velocity and act as projectiles themselves.

The shaft or rod of the spear would normally be a single piece of a hard and tough material such as steel or tungsten. Alternately, the rod may be made out of more than one material in order to obtain a very hard front and/or a more advanced center of gravity.

The appendages, such as the fairings, wings, rocket motors and tail surfaces should easily come apart from the rod upon impact with the ground and may be of a lightweight material such as aluminum. Upon entering the ground, the spear should be smooth and axially symmetric, without any protrusions. The collar type attachments shown in FIGS. 2, 4 and 5 are particularly designed to slip off the stem following impact.

The enlarged or bulb-shaped front end of the rod should have a diameter approximately 5 to 10% larger than the main rod diameter. This enlarged front end is required to reduce or avoid the clamping effect of the ground around a penetrating rod. If for some reason a soft material such as mild steel is used for the rod, the enlarged front end may not be necessary in view of the plastic deformation of the front of the rod which would occur upon impact.

The conical cavity for the explosive charge in the rod must be at the rear of the stem to avoid collapse upon impact. The transition from the main rod to the cavity should be smooth to avoid any locai stress concentrations. A delayed fuse which can sense the end of the spear's deceleration can be provided for this charge.

The rocket motors should be designed for the specific application to provide the required acceleration to the spear. For the winged spear of FIGS. 3, 4, and 5 launched as illustrated in FIG. 10, an Athena Stage IV motor delivering a total impulse of 52,800 lb. sec in 9.16 sec would be suitable. This motor weighs 214 lbs and is 32.6 inches long with a diameter of approximately 19 inches. This particular embodiment is suitable for a steel spear having a diameter of 5 inches and a length of about 5 feet and is designed to penetrate 15 feet of concrete.

For the multiple rocket motor spear of FIGS. 7 and 8, a zuni type motor can be utilized. The Zuni motor, with a 5 inch diameter and 62 inch length can deliver a total impulse of 6825 lb. sec in 1.05 sec.

While the impact of the spear should be axial for a good penetration, some obliquity may be tolerated. A spear impacting normally a honogeneous target, penetrates it on a straight path until it stops. The same is true if the angle of obliquity is small or if the impact velocity is high. For lower impact velocity or for higher obliquity the penetration path becomes curved and in the limit ricochet takes place. In order to favor penetration under oblique impact or to indent hard rock or concrete, a frontal, hollow-shaped charge may be provided with the frontal fairing to reduce the possibility of bending and/or ricochet.

As previously indicated the spear should be specifically designed for its particular target. Assume that the target is concrete having a specific gravity of 0.085 lb/in$^3$ and a reference strength of 100,000 lb/in$^2$ and that the desired penetration depth is 16 ½ feet. A steel spear 5 inches in diameter and 7 ½ feet long having an optimum impact velocity of 2620 ft/sec and a momentum of 90,000 lb/sec at impact will produce this penetration. The rod, of steel having a weight per unit volume of 0.28 lb/in$^3$ and a reference strength of 200,000 lb/in$^2$ will weigh 495 lbs.

A tungsten rod for the same target would be much shorter but slightly heavier and with a lower impact velocity. The percentage loss by erosion will be greater for the tungsten rod. The greater density of tungsten permits the shorter rod which allows for better stability against buckling.

Once the penetrating rod is defined, the rocket motor can be added and the aerodynamic surfaces configured. It has been found that optimum penetration is achieved if the majority of the weight is distributed between the solid front part of the rod and the rocket motor necessary to achieve optimum velocity.

FIGS. 9, 10, 11 and 12 illustrate launch or delivery of the spear from an aircraft. The spear can also be launched from the surface or from a ship when provided with suitable propulsion and guidance.

While specific embodiments of the invention have been illustrated and described, it is to be understood that these embodiments are provided by way of example only and that the invention is not to be construed as being limited thereto but only by the proper scope of the following claims.

I claim:

1. A penetrating spear comprising:

an elongated solid rod, of a hard metal, having a length many times its diameter, said rod additionally having an integral blunt bulb-shaped front end with a diameter between 5 to 10% larger than the diameter of the remainder of said rod;

propulsion means secured adjacent the rear portion of said rod to accelerate the spear to an optimum velocity before impact with a target; and a plurality of aerodynamic surfaces disposed around said rod to control and stabilize the spear during flight, said plurality of aerodynamic surfaces including a frontal conical fairing disposed at the front of said rod, a plurality of aerodynamic fairing surfaces extending from said rod to said propulsion means, and a plurality of stabilizer tail surfaces extending outward from said propulsion means.

2. The penetrating spear of claim 1 and in addition an explosive charge disposed within said frontal conical fairing.

3. A penetrating spear comprising:

an elongated solid rod, of a hard metal, having a length many times its diameter, said rod additionally having an integral blunt bulb-shaped front end which has a diameter slightly larger than the remainder of said rod;

a frontal conical fairing disposed at the front of said rod;

aerodynamic surface support means slidably disposed about the rear portion of said rod;

a plurality of aerodynamic surfaces affixed to said support means to control and stabilize the spear during flight and to slide off said rod with said support means upon impact; and propulsion means affixed adjacent the rear portion of said rod to accelerate the spear to an optimum velocity before impact with a target.

4. The penetrating spear of claim 3 and in addition an explosive charge disposed within said frontal conical fairing.

* * * * *